United States Patent [19]

Stinson et al.

[11] 4,019,785

[45] Apr. 26, 1977

[54] DRILL BIT UTILIZING LUBRICANT THERMAL EXPANSION AND RELIEF VALVE FOR PRESSURE CONTROL

[75] Inventors: Leon Berthal Stinson; Edward Milburn Galle, both of Houston, Tex.

[73] Assignee: Hughes Tool Company, Houston, Tex.

[22] Filed: May 30, 1975

[21] Appl. No.: 582,506

[52] U.S. Cl. ..... 308/8.2; 184/6.21; 308/187

[51] Int. Cl.[2] ..... F16C 19/00

[58] Field of Search ..... 308/8.2, 187; 184/6.21

[56] References Cited

UNITED STATES PATENTS 3,721,306 3/1973 Sartor ..... 308/8.2 X

OTHER PUBLICATIONS

Production Control Units Product Bulletin No. 105–A, 106–A published 12/28/66.

*Primary Examiner*—Joseph F. Peters, Jr.
*Assistant Examiner*—Gene A. Church
*Attorney, Agent, or Firm*—Robert A. Felsman

[57] ABSTRACT

Disclosed herein is a drill bit for earth boring, including a lubrication system that eliminates necessity for a complex system to accomplish pressure compensation. Since the temperature of the earth generally increases with depth from the surface, a drill bit experiences increasing temperature with increasing depth. The coefficient of thermal expansion of lubricant inside a bit is greater than that of the metal defining the walls of the lubricant cavities. Internal bearing lubrication pressure control is achieved utilizing thermal expansion of the lubricant, seal displacement, and a pressure relief valve.

9 Claims, 7 Drawing Figures

DRILL BIT UTILIZING LUBRICANT THERMAL EXPANSION AND RELIEF VALVE FOR PRESSURE CONTROL

BACKGROUND OF THE INVENTION

1. Field of the Invention

This invention relates in general to earth boring drill bits and in particular to improved means for their lubrication.

2. Description of the Prior Art

Earth drill bit commonly utilize bearing lubrication systems. The successful lubrication of drill bit bearings depends upon an effective seal such as that disclosed in U.S. Pat. No. 3,397,928 issued to Edward M. Galle. The lubrication system typically includes a compensator that equalizes the pressure differential across the seal, as described in U.S. Pats. to Cunningham, Nos. 3,007,750 and 3,137,508. Further, it is advantageous to include a pressure relief valve to limit the internal lubrication system pressure to a selected magnitude above the pressure in the well bore, as disclosed in U.S. Pat. No. 3,476,195 issued to Edward M. Galle.

Though previously known lubrication systems for drill bits have been successful, certain problems persist. The prior art rubber diaphram compensators sometimes become damaged. Their manufacture and assembly requires careful attention. The prior art compensators have numerous areas that require sealing to avoid lubricant loss or entrance of ambient drilling fluids. In general, the prior art compensator systems have a degree of complexity that should be avoided to improve reliability.

SUMMARY OF THE INVENTION

It is therefore the general object of this invention to provide a drill bit having a simplified lubrication system that achieves pressure control of the lubricant with a reduced number of components. This object is accomplished in general by eliminating complex pressure compensation structures. The system is filled with a lubricant essentially free of all air and gas. The lubricant experiences thermal expansion with increasing hole depth. Lubrication pressure control is achieved with a pressure relief means and seal displacement. The system comprises a closed cavity isolated from external pressures except for displacement of the seal. The walls of the cavity are rigid except for the seal, which with the pressure relief means and thermal expansion of the lubricant accomplishes lubricant pressure control. Additional objects, features, and advantages of the invention will become apparent in the following description.

DESCRIPTION OF THE PREFERRED EMBODIMENT

In a copending application filed of even date herewith Edward M. Galle discloses an invention entitled "Fully Lubricated Earth Boring Drill Bit" that utilizes vacuum filling and degassed lubricant to eliminate substantially all air and gas in the lubrication system of a drill bit to improve lubrication. The present invention involves the recognition it is possible to eliminate the compensator and utilize only a pressure relief valve and displacement of the seal between cutter and shaft to control lubricant pressure. This invention is practicable since lubricant pressure increases with depth faster than does hydrostatic pressure at the bottom of a well bore when using drilling mud of typical density.

Figure 7:
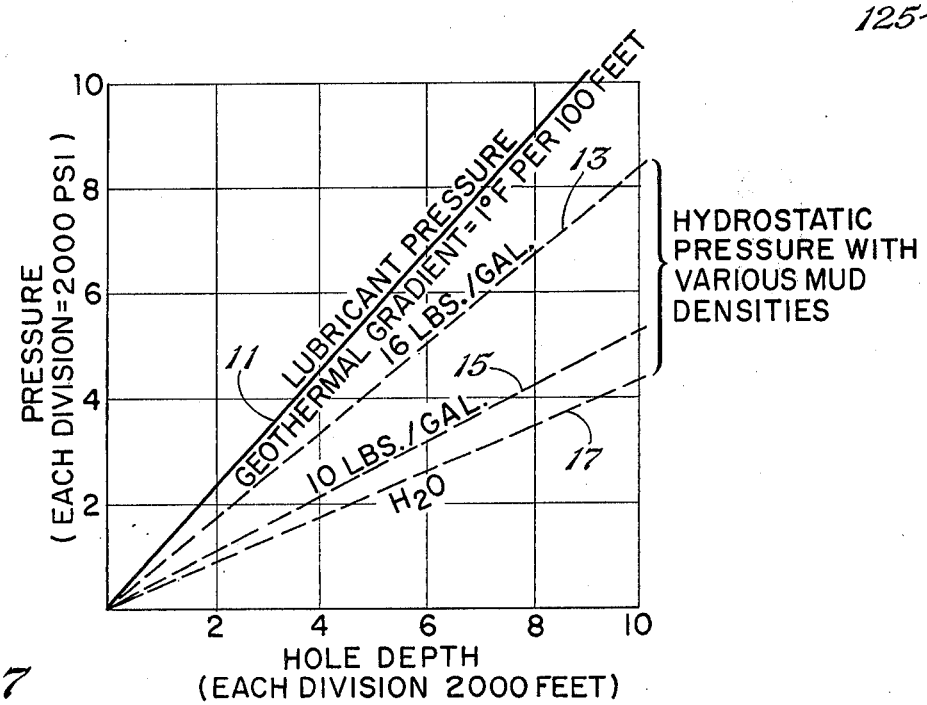
FIG. 7 is a graph in which one curve shows the correlation of lubricant pressure in a bit versus hole depth in the earth for a geothermal gradient of 1° F. per 100 feet. The other three curves show hydrostatic pressure of the fluid surrounding the bit versus depth when the fluid is respectively water, drilling mud with a density of 10 pounds per gallon and drilling mud with a density of sixteen pounds per gallon.

FIG. 7 is a graph which plots increases in lubricant pressure versus hole depth as indicated by the curve 11. This increase in bearing pressure is caused by the increasing temperature of the lubricant as it is warmed geothermally with increasing depth. For the graph of FIG. 7, a geothermal gradient of 1° F. per 100 feet is assumed, although the geothermal gradient varies geographically. Also included in FIG. 7 are curves 13, 15 and 17, showing respectively how the hydrostatic pressure of a drilling fluid in a well bore increases with depth with drilling muds of densities respectively of sixteen pounds per gallon, ten pounds per gallon and with water (8.3 pounds per gallon). Thus FIG. 7 shows that typically the pressure of the lubricant inside the bearing rises with depth faster than does the hydrostatic pressure of the fluid surrounding the bit. Thus a successful drill bit can be achieved, as described below, through utilization of a lubrication system that relieves increasing internal pressure. Therefore, additional compensation such as that described in the above mentioned copending application of Edward M. Galle is unnecessary, and indeed has disadvantages, as contrasted with the system described below.

Figures 1, 5:
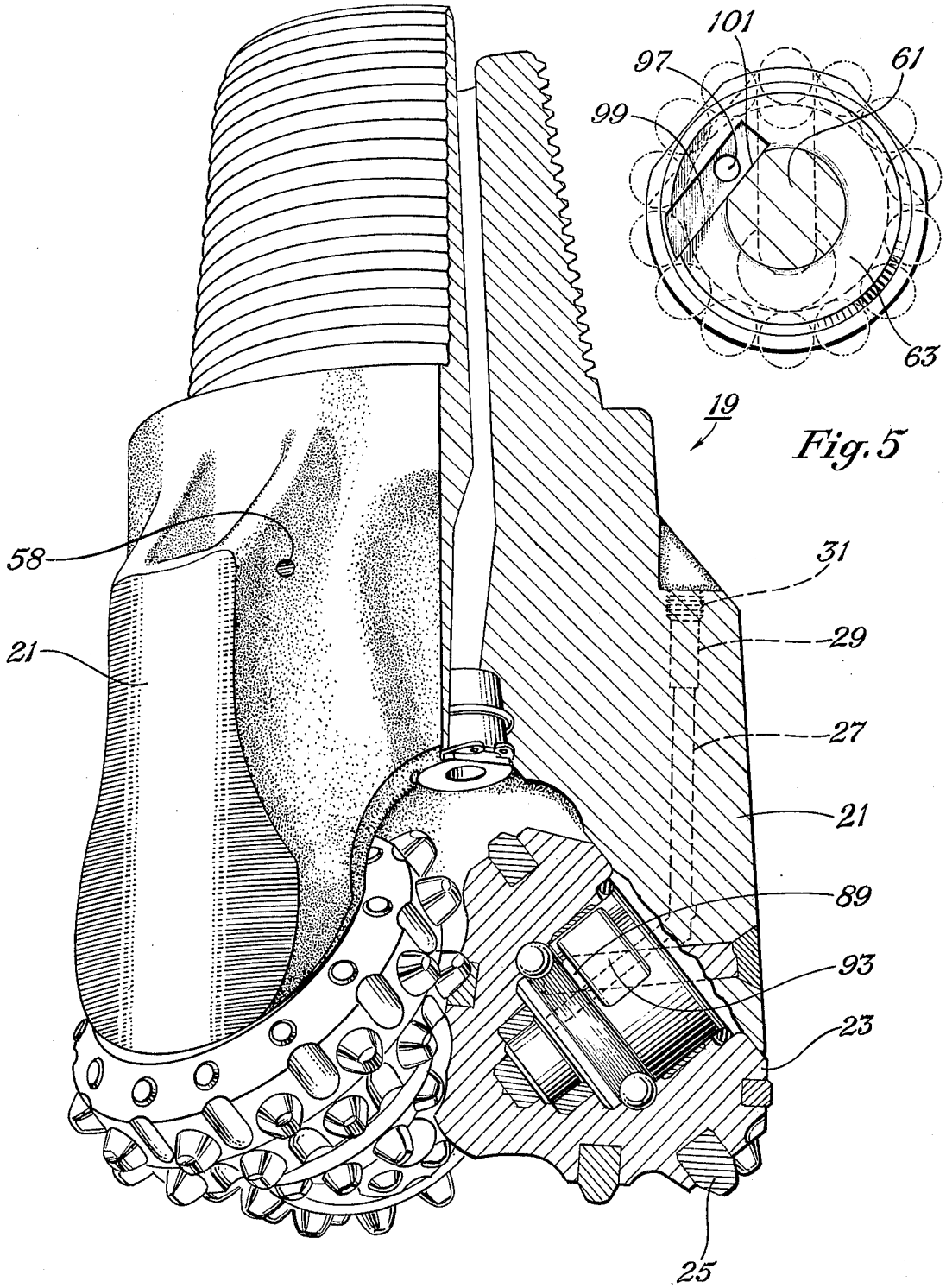
FIG. 1 is a perspective view, partially in sections, of an earth boring drill bit having a lubrication system in accordance with the principles of the invention.
FIG. 5 is a cross-sectional view as seen looking along the lines V—V of FIG. 2.
Figure 3:
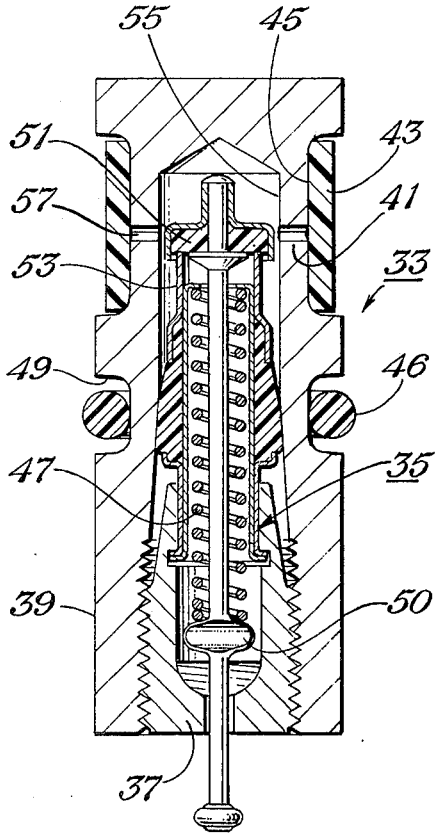
FIG. 3 is a longitudinal sectional view of a pressure relief valve.
Figure 2:
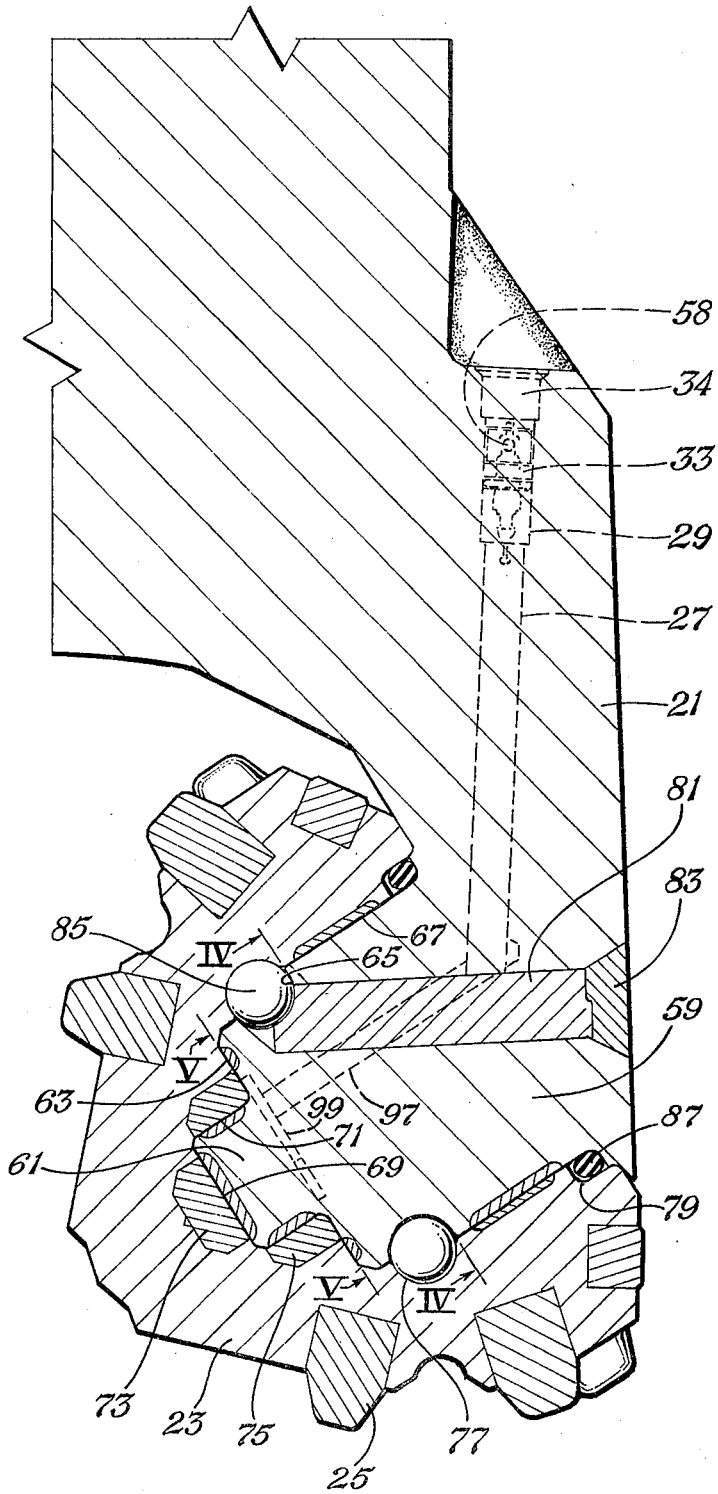
FIG. 2 is a view in longitudinal and fragmentary section of a portion of the drill bit shown in FIG. 1.

The numeral 19 in FIG. 1 of the drawing designates a lubricated, rotatable cutter type earth boring drill bit having a body formed with three head sections 21, each supporting a rotatable cutter 23 having earth disintegrating teeth 25. A filler hole 27 has an enlarged upper region 29, threaded at 31 to receive a pressure relief valve 33 and a retaining plug 34, as seen generally in FIG. 2 and in greater detail in FIG. 3. The central relief portion 35 of the relief valve has the same general construction as disclosed in U.S. Pat. No. 3,476,195 issued to Edward M. Galle. It is retained by a threaded cap 37 to a cylindrical housing 39 which has one or more radial ports 41 covered by an elastomeric sleeve 43 in an annular groove 45. The sleeve functions as a secondary pressure relief means and has as a primary purpose protection of the central, spring-type relief portion. An O-ring 46 is included in a groove 49 of the housing 39 to seal against the enlarged upper portion 29 of the filler hole 27. When the pressure of the lubricant inside the filler hole 27 exceeds the relief pressure of the relief valve 33, the resilient pad 51 lifts from the end of tube 53, enabling discharge of lubricant into the axial passage 55, through radial ports 57 and outward beneath the elastomeric sleeve 43 and from the bit through hole 58 in the associated head section. By this means, the pressure of the lubricant inside the lubrication system is limited to a selected value above the ambient drilling fluid pressure.

A bearing shaft or pin 59 extends inwardly in cantilever fashion from each head section 21 and terminates in a pilot pin 61 extending from a thrust face 63. A ball bearing raceway 65 is formed on the shaft, as is a friction bearing surface 67. The end 69 of the pilot pin may include a deposit of bearing material such as one of the cobalt base alloys, as may be surface 71 of the pilot pin and surface 72 of the friction bearing surface 67.

The cutter 23 has a thrust button 73 to engage the end of the pilot pin, a bushing 75 to engage its cylindrical surface 71, a ball race 77 and a seal ring groove 79, generally L-shaped. A plug 81 is welded at 83 to the leg 21 to fill a mating hole through which the balls 85 are fed to fill the matching raceways 65, 77 to retain the cutter on the bearing shaft. The O-ring 87 is capable of displacement by distortion and also by movement a selected amount on the bearing shaft and in the L-shaped groove 79 of the cutter.

Figure 4:
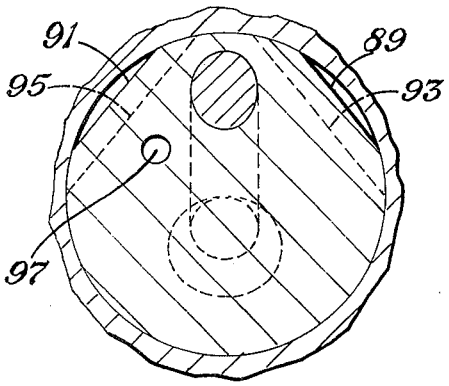
FIG. 4 is a cross-sectional view as seen looking along the lines IV—IV of FIG. 2.

As seen in the cross-sectional view of FIG. 4 and to some extent in FIG. 1, the bearing shaft is flattened as indicated by the numerals 89 and 91 and is slotted as indicated by the numerals 93 and 95 to form pockets and passages for lubricant reserve. While lubricant loss is minimized with the disclosed sealing system, some leakage may be expected. The pocket type lubricant reserve permits a predetermined amount of loss without detriment. A drilled hole 97 extends between the filler hole 27 and a slot 99 (see FIG. 5) formed in the thrust face 63 and across a portion of the pilot pin 61 to form a flat 101 thereon for the improved flow of lubricant.

Figure 6:
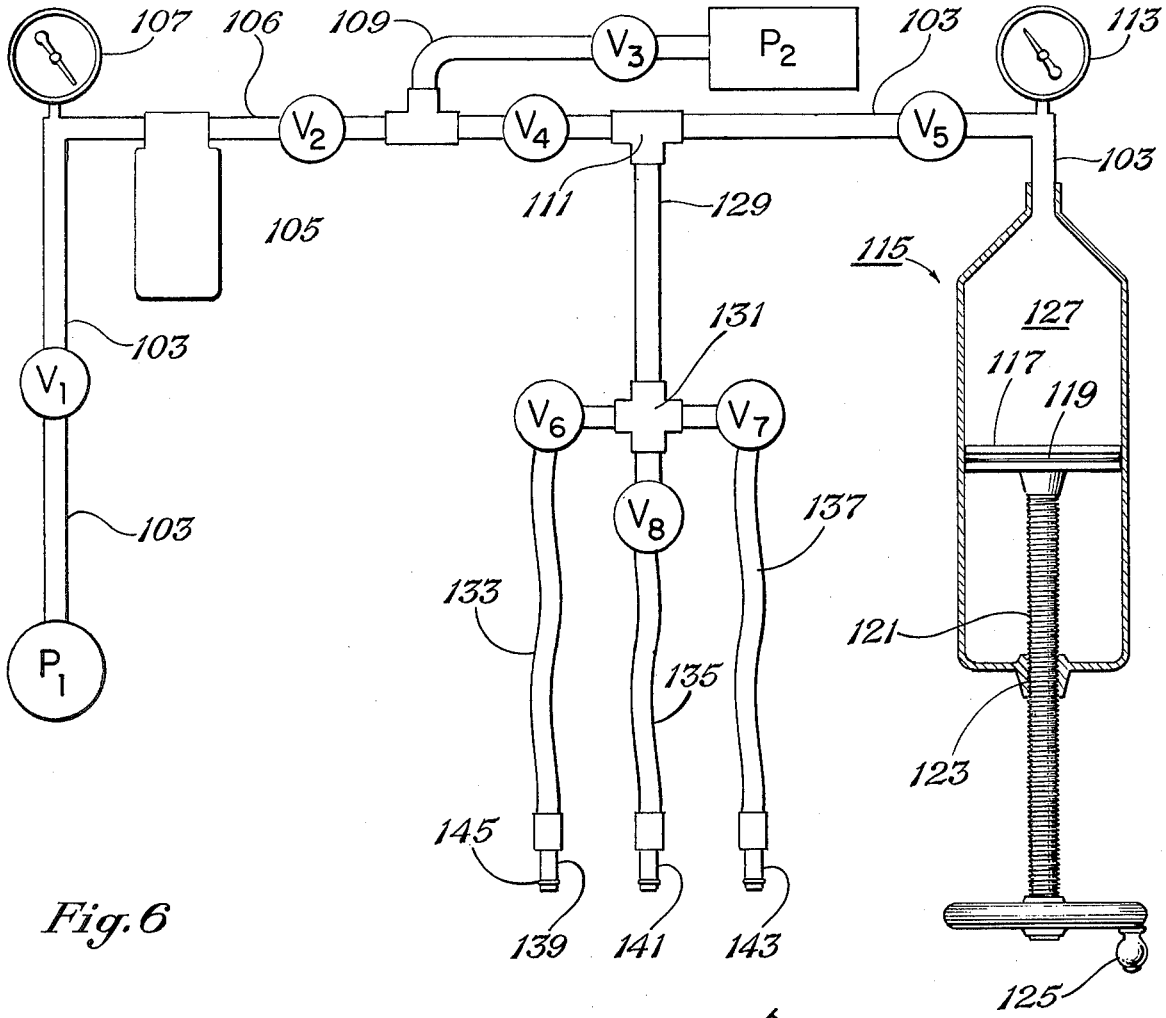
FIG. 6 is schematic representation of apparatus used to lubricate the bit shown in FIG. 1.

The lubricant system is preferably filled with a degassed lubricant by a method that eliminates essentially all air and gas in the system by means of apparatus shown schematically in FIG. 6 of the drawing. A vacuum pump $P_1$ is connected by a pipe or conduit 103 and through a valve $V_1$ with a sump 105, there also being a vacuum gage 107 connected with conduit 103 intermediate valve $V_1$ and the sump 105.

"T" connection 107 connects a valve $V_3$ and an air supply $P_2$ through conduit 109 with conduit 103, which extends to valve $V_4$, another "T" connection 111, valve $V_5$, pressure gage 113, and ultimately to a chamber 115 that contains a piston 117 sealed with O-ring 119 against the interior side wall of the chamber. Screw 121 engage mating threads 123 in a lower region of the chamber and when rotated with handle 125, selectively enlarges or decreases a sealed volume 127 in the chamber.

From "T" connection 111 a conduit 129 leads to a manifold 131 connected to three separate conduits 133, 135, 137 respectively through valves $V_6$, $V_8$, $V_7$ to nipples 137, 141, 143, each having a sealing O-ring 145.

The lubricant used to fill the bit should be substantially free of air and gas. Otherwise, the increase in lubricant pressure, as shown by curve 11 in FIG. 7, will be substantially less than shown. If enough air or gas is trapped in the bearing, the hydrostatic pressure may be greater than the lubricant pressure. Air and gas removal may be accomplished with the apparatus shown in FIG. 6 by opening valves $V_1$, $V_2$, $V_4$ and $V_5$ while closing valves $V_3$, $V_6$, $V_7$ and $V_8$. Pump $P_1$ is energized to pull a vacuum of preferably substantially equal to atmospheric pressure. The lubricant in sealed volume 127 of chamber 115 is subjected to this vacuum for a period of about 24 hours. This had been found sufficient to rid a lubricant with a viscosity of 1200 Seconds Saybolt Universal at 100° F. of substantially all air and gas.

The lubricating passages and spaces of the drill bit are also evacuated of air and gas, but not necessarily simultaneously with the degassing of the lubricant. Each nipple 139, 141, 143 is connected to an enlarged region or recess 29 of each of the three filler holes 27 of a three cone bit, the O-rings 145 forming a fluid tight seal. The previously described passages and spaces are than evacuated by opening valves $V_6$, $V_7$, $V_8$ to the vacuum pump $P_1$. Valve $V_5$ may remain open or may be closed.

After both the lubricant and the passages and spaces are substantially free of air and gas, valve $V_1$ is closed and the system checked for leaks by observing gage 107. If no gage variation is detected, valve $V_4$ is closed to block the lubricant, valve $V_5$ opened and lubricant forced into the passages and spaces of the drill bit by turning screw handle 125 to move piston 117 inwardly. The desired pressure, which for the disclosed viscosity is about 500 psi (pounds per square inch), will be indicated by gage 113.

After filling, valve $V_5$ is closed, the nipples 139, 141, 143 are removed from the bit, and a pressure relief valve 33 and retaining plug 34 inserted into each enlarged upper region 29 of each filler hole 27. If any appreciable amount of bleed-back of lubricant occurs when nipples 93, 95, 97 are removed from the bit, this indicates that either the lubricant was not properly degassed or that the passages and spaces were not properly evacuated.

To prepare for the next drill bit which must be evacuated prior to being filled with lubricant, the lubricant within conduits 129, 133, 135, 137 and conduit 103 between valve $V_4$ and "T" 111 must be removed. This is accomplished by opening valve $V_3$ to the air supply $P_2$, while closing valves $V_2$ and $V_5$ and two of the valves $V_6$, $V_7$, $V_8$. The air forces the remaining lubricant from the conduit associated with the open valve $V_6$, $V_7$ or $V_8$. Each conduit 133, 135, 137 should be purged of lubricant in this manner.

When the conduits 129, 133, 135, 137 have been purged, valve $V_3$ is closed and the nipples 139, 141, 143 connected to the filler holes of a second bit for evacuation and lubrication as previously described. Should any lubricant remain in the conduits and be drawn towards the vacuum, it will be collected in sump 105. If there is sufficient lubricant remaining in chamber 115 from the prior filling, then the degassing of the lubricant step may be eliminated. When necessary to replenish the lubricant, chamber 115 may be detached from conduit 103, piston 117 withdrawn to enlarge the sealed volume 127, and fresh lubricant introduced. The fresh lubricant should be degassed as previously discussed.

In operation and during drilling with a bit of the preferred embodiment filled with lubricant by the apparatus and method described, the volumetric expansion of the lubricant, due to geothermal temperature increase as illustrated in FIG. 7 and due to bearing friction, causes the pressure of the lubricant in the closed cavity to increase more rapidly than does the hydrostatic pressure of the drilling fluid in the well bore surrounding the bit. If the lubricant pressure exceeds the pressure required to open the relief valve, some lubricant is expelled to maintain pressure below a selected value. Further, the O-ring is capable of axial movement and will therefore compensate for some pressure differences to help maintain the pressure across the seal in a selected range of values. The lubrication system is isolated from the external pressures except for displacement of the seal in the preferred embodiment.

It should be apparent from the foregoing that an invention having significant advantages has been provided. The invention eliminates the need for additional compensators of the type described in the copending application of Edward M. Galle, "Fully Lubricated Earth Boring Drill Bit". All necessary compensation is achieved by utilizing the thermal expansion of the lubricant, the pressure relief valve and to a limited extent the volume displacement of the seal between the cutter and its supporting shaft. The elimination of additional components simplifies manufacture and assembly and leads to greater reliability by minimizing: the total possible number of manufacturing and assembly errors; the number of sealing areas in the bit; and the number of components that could possibly fail during operation.

While the invention has been shown in only one of its forms, it should be apparent to those skilled in the art that it is not so limited, but is susceptible to various changes and modifications without departing from the spirit thereof. The principles of the invention may be achieved with structures and geometries other than the preferred embodiment.

We claim:

1. In an earth boring drill bit having a rotatable cutter retained on a bearing shaft, a lubrication system, and seal means between the cutter and shaft, the improvement comprising:
   - lubricant in a closed and rigid cavity of a lubrication system isolated from external pressure except for displacement of the seal means;
   - pressure relief means in the lubricant system to discharge lubricant responsive to thermally induced expansion;
   - said lubrication system pressure being controlled by the pressure relief means.

2. In an earth boring drill bit having a rotatable cutter retained on a bearing shaft, a lubrication system, and seal means between the cutter and shaft, the improvement comprising:
   - a degassed lubricant in a lubrication system that is evacuated to be substantially free of air and gas and isolated from external pressure except for displacement of the seal means;
   - pressure relief means in the lubricant system to discharge lubricant responsive to thermally induced expansion;
   - said lubrication system pressure being controlled by the pressure relief means;
   - said seal means being movable between said cutter and shaft for pressure equalization.

3. In an earth boring drill bit having a rotatable cutter retained on a bearing shaft and passages and spaces for lubrication, a lubrication system, and seal means between the cutter and shaft, the improvement comprising:
   - a filler hole in the lubrication system for evacuation of air and gas and subsequent filling with lubricant;
   - lubricant introduced into the lubrication system through said filler hole and being substantially free of air and gas;
   - a pressure relief valve disposed in the lubricant system to discharge lubricant and control lubricant pressure;
   - said lubrication system pressure being controlled by the pressure relief valve and seal displacement while otherwise isolated from external pressures.

4. The invention defined by claim 3 wherein said pressure relief valve is disposed in said filler hole.

5. In an earth boring drill bit having a rotatable cutter retained on a bearing shaft, a lubrication system, and seal means between the cutter and shaft, the improvement comprising:
   - a filler hole in the lubrication system for evacuation of air and gas and subsequent filling with lubricant;
   - lubricant introduced into the lubrication system through said filler hole and being substantially free of air and gas;
   - a pressure relief valve in the lubricant system to discharge lubricant and control lubricant pressure;
   - said shaft having one or more pockets facing the cutter of lubricant reserve;
   - said lubrication system pressure being controlled by the pressure relief valve and seal displacement and otherwise isolated from external pressures;
   - means covering said filler hole.

6. In an earth boring drill bit having a rotatable cutter retained on mating surfaces of a bearing shaft, and a lubrication system, the improvement comprising:
   - the lubrication system having passages and spaces defining a closed and rigid cavity filled with lubricant evacuated of substantially all air and gas;
   - the lubrication system including, between the rotatable cutter and bearing shaft, an O-ring seal capable of movement responsive to pressure changes of the lubricant and in the hydrostatic pressure;
   - pressure relief means in the lubricant system to limit pressure by discharging lubricant responsive to thermally induced volumetric lubricant expansion;
   - said lubrication system being isolated from external pressures except for displacement of the O-ring seal.

7. In an earth boring drill bit having a rotatable cutter retained on mating surfaces of a bearing shaft, and a lubrication system, the improvement comprising:
   - the bit having a leg containing a filler hole;
   - the bearing shaft having a passage intersecting the filler hole and communicating with said mating surfaces between the cutter and shaft;
   - said filler hole, passage and mating surfaces being evacuated to be substantially free of all air and gas and filled with lubricant;
   - the lubrication system including, between the rotatable cutter and bearing shaft, seal means capable of movement responsive to pressure changes of the lubricant and in the hydrostatic pressure;
   - a pressure relief means in the lubricant system to limit pressure by discharging lubricant responsive to thermally induced volumetric lubricant expansion;
   - said lubrication system being isolated from external pressures except for movement of the seal means.

8. In an earth boring drill bit having a rotatable cutter retained on mating surfaces of a bearing shaft, and a lubrication system, the improvement comprising:

a leg of the bit containing a filler hole;

a thrust face between said cutter and shaft;

the bearing shaft having a passage intersecting the filler hole and communicating with a slot in the thrust face and said mating surfaces between the cutter and shaft;

said filler hole, passage, slot and mating surfaces being evacuated to be substantially free of all air and gas and filled with lubricant;

the lubrication system including, between the rotatable cutter and bearing shaft, seal means capable of movement responsive to pressure changes of the lubricant;

a pressure relief means disposed in said filler hole in the lubricant system to limit pressure by discharging lubricant responsive to thermally induced volumetric lubricant expansion during drilling.

9. The invention defined by claim 8 which further comprises at least one pocket on the bearing shaft facing the cutter for lubricant reserve.

* * * * *